US009204744B2

(12) United States Patent
Vacanti

(10) Patent No.: US 9,204,744 B2
(45) Date of Patent: Dec. 8, 2015

(54) DRINKWARE

(71) Applicant: Margarita D. Vacanti, Lakewood, CO (US)

(72) Inventor: Margarita D. Vacanti, Lakewood, CO (US)

( * ) Notice: Subject to any disclaimer, the term of this patent is extended or adjusted under 35 U.S.C. 154(b) by 0 days.

(21) Appl. No.: 13/900,881

(22) Filed: May 23, 2013

(65) Prior Publication Data

US 2013/0313221 A1 Nov. 28, 2013

Related U.S. Application Data

(60) Provisional application No. 61/651,490, filed on May 24, 2012.

(51) Int. Cl.
*A47G 19/22* (2006.01)

(52) U.S. Cl.
CPC ..... *A47G 19/2205* (2013.01); *A47G 2400/04* (2013.01)

(58) Field of Classification Search
CPC ..... A47G 19/2205; A47G 2400/045
USPC ..... 215/378, 380, 374; 220/636
See application file for complete search history.

(56) References Cited

U.S. PATENT DOCUMENTS

| | | | | | |
|---|---|---|---|---|---|
| 297,174 | A | * | 4/1884 | Seymour | 215/378 |
| 307,630 | A | * | 11/1884 | Clark | 215/378 |
| 355,486 | A | * | 1/1887 | Thompson | 215/200 |
| 362,413 | A | * | 5/1887 | Atterbury | 215/374 |
| 445,057 | A | * | 1/1891 | Harroun | 220/23.87 |
| 559,905 | A | * | 5/1896 | Pike | 210/477 |
| 565,922 | A | | 8/1896 | Prax | |
| 1,694,754 | A | * | 12/1928 | Porter | 215/378 |
| 1,744,947 | A | | 1/1930 | Bowman | |
| 1,865,023 | A | | 6/1932 | Leavy | |
| 1,943,866 | A | * | 1/1934 | Holl | 215/377 |
| 1,986,958 | A | * | 1/1935 | Cooperstein | 215/377 |
| 2,169,426 | A | * | 8/1939 | Morton | 215/12.1 |
| 2,187,558 | A | * | 1/1940 | Kushima | 215/12.1 |
| 2,779,472 | A | | 1/1957 | Febbraro | |
| 3,191,645 | A | * | 6/1965 | Dailey | 141/381 |
| 4,428,490 | A | * | 1/1984 | Holloway | 215/374 |
| 4,555,040 | A | * | 11/1985 | Butenschon | 215/365 |
| 4,600,125 | A | * | 7/1986 | Maynard, Jr. | 222/81 |

(Continued)

FOREIGN PATENT DOCUMENTS

| | | |
|---|---|---|
| CN | 201806402 | 4/2001 |
| DE | 1906783 | 3/1970 |

(Continued)

OTHER PUBLICATIONS

Printed web page from www.riedel.com.

*Primary Examiner* — Fenn Mathew
*Assistant Examiner* — Chetan Chandra
(74) *Attorney, Agent, or Firm* — Boardman & Clark LLP

(57) ABSTRACT

The present application relates to drinkware having one or more features adapted to help separate, segregate, confine, contain, and/or trap sediment present in various beverages. In various embodiments, the drinkware, which includes a bowl having a bottom region, a base, and a stem coupling the bowl to the base, defines a cavity at least partially within the stem into which sediment present in beverages may settle to help keep at least some of the sediment from being consumed from the drinkware. In various embodiments, the cavity has a spiral, helical or corkscrew shape or configuration. In various embodiments, the cavity is conical.

18 Claims, 8 Drawing Sheets

(56) References Cited

U.S. PATENT DOCUMENTS

| | | | | |
|---|---|---|---|---|
| D305,392 | S * | 1/1990 | Durand | D7/525 |
| 5,402,907 | A * | 4/1995 | Liu | 220/502 |
| 5,614,236 | A | 3/1997 | Klang | |
| 5,616,242 | A | 4/1997 | Mandola | |
| 5,713,263 | A | 2/1998 | Burks | |
| 5,746,113 | A | 5/1998 | Ko | |
| 6,260,474 | B1 | 7/2001 | Yahav | |
| D479,668 | S * | 9/2003 | McMullin | D7/525 |
| 6,640,989 | B2 * | 11/2003 | Matsui | 215/377 |
| 6,662,959 | B1 * | 12/2003 | Westerhold | 215/378 |
| 6,739,363 | B2 * | 5/2004 | Walter et al. | 141/331 |
| D497,773 | S | 11/2004 | Riedel | |
| 6,905,038 | B2 * | 6/2005 | Lopez | 215/228 |
| 6,945,418 | B2 | 9/2005 | Guido et al. | |
| D535,559 | S * | 1/2007 | Kehoe | D9/440 |
| 7,188,743 | B1 | 3/2007 | Gates et al. | |
| D560,436 | S | 1/2008 | Mangano | |
| 7,543,717 | B2 * | 6/2009 | Hinkle | 220/508 |
| D605,465 | S | 12/2009 | Benton et al. | |
| D617,643 | S | 6/2010 | John | |
| 7,775,393 | B1 * | 8/2010 | Feldman et al. | 220/709 |
| 7,861,888 | B2 * | 1/2011 | Niedzwiecki | 220/703 |
| 7,975,872 | B2 | 7/2011 | Lardino | |
| 8,101,222 | B2 | 1/2012 | Burroughs et al. | |
| 8,430,023 | B2 * | 4/2013 | Hynes | 99/323.1 |
| 2005/0139570 | A1 * | 6/2005 | Lambert et al. | 215/223 |
| 2006/0073241 | A1 * | 4/2006 | Vallentine | 426/106 |
| 2007/0062961 | A1 * | 3/2007 | Rigas | 220/703 |
| 2007/0256568 | A1 * | 11/2007 | Nudi et al. | 99/275 |
| 2007/0267422 | A1 * | 11/2007 | Barducci | 220/608 |
| 2008/0290101 | A1 * | 11/2008 | Stecca | 220/703 |
| 2008/0290102 | A1 * | 11/2008 | Mangano | 220/703 |
| 2009/0212053 | A1 * | 8/2009 | Lardino | 220/62.12 |
| 2010/0025867 | A1 * | 2/2010 | Benton et al. | 261/110 |
| 2011/0271846 | A1 * | 11/2011 | Hynes | 99/323.1 |
| 2012/0055955 | A1 * | 3/2012 | Fukunaga | 222/185.1 |
| 2012/0167775 | A1 * | 7/2012 | Burroughs et al. | 99/323.1 |
| 2012/0201942 | A1 * | 8/2012 | Kilduff et al. | 426/474 |
| 2013/0020333 | A1 * | 1/2013 | Scott | 220/630 |
| 2013/0313221 | A1 * | 11/2013 | Vacanti | 215/374 |
| 2014/0004242 | A1 * | 1/2014 | Lefkovitz | 426/489 |
| 2014/0041751 | A1 * | 2/2014 | Stern et al. | 141/1 |

FOREIGN PATENT DOCUMENTS

| | | | | |
|---|---|---|---|---|
| DE | 3227303 | A1 * | 2/1984 | A47G 19/22 |
| DE | 19757413 | | 7/2000 | |
| JP | 11196994 | | 7/1999 | |

* cited by examiner

DRINKWARE

CROSS REFERENCE TO RELATED APPLICATIONS

This application claims priority to and benefit of U.S. Provisional Patent Application Ser. No. 61/651,490, filed May 24, 2012, which is hereby incorporated herein by reference in its entirety.

BACKGROUND

The present application relates to drinkware including, without limitation, drinking vessels and containers, barware and glassware. The present application further relates to drinkware with one or more features which may help separate, confine and/or trap sediment present in various beverages, and/or have aesthetic appeal.

Many beverages contain sediment. For example, beverages derived from plants may contain sediments such as tannins, pulp, dregs, leaves, fruit skins, stems, and/or other plant parts. As a further example, when wine is fermented with grapes, and especially the red grape variety (e.g., Bordeaux, cabernets, and Super Tuscans), it typically includes tannin. Tannin is a substance that exists naturally in grapes. In addition, oak barrels can also contribute tannin to wines, both reds and whites. Coffee and tea can also include tannin.

Tannin has some disadvantages. For example, tannin can discolor teeth. This is one reason why dentists suggest limiting coffee and tea intake. Tannin can also impede a body's ability to absorb iron which may adversely affect an otherwise balanced diet. Tannin is also believed to cause migraines in certain people. Tannin can cause a bitter taste in beverages. The separation, removal or containment of tannin can result in better-tasting and/or healthier beverages, and/or an improved texture.

Coffee and tea can also include other sediment such as coffee grinds, tea leaves or other sediment from, for example, tea bags. Juices also often include sediment. Beer and other alcohol beverages may also include sediment. For example, unfiltered or roughly-filtered beer often includes sediment. In addition, a variety of cocktails and hard alcohols (e.g., infused alcohols) include sediment. Some prefer such beverages and drinks with little or no sediment, and, for them, the separation or confinement of sediment before or during consumption may be advantageous.

SUMMARY

Thus, there is a need for drinkware which is effective in helping remove, contain or otherwise segregate sediment from the beverages it holds. There is also a need for drinkware that helps trap, contain, separate or segregate sediment from the rest of the beverage while providing an aesthetically-pleasing appearance.

The present disclosure is generally directed to drinkware comprising: a bowl having a bottom region, and defining a receptacle area and a top opening; and a stem coupled to the bowl; wherein the bottom region and stem define a cavity in open communication with the receptacle area; and wherein at least a portion of the cavity is helical in shape.

The present disclosure is also generally directed to drinkware comprising: a bowl having a bottom region, and defining a receptacle area and a top opening; wherein the bottom region helps define a cavity in open communication with the receptacle area; and wherein at least a portion of the cavity is helical in shape.

The present disclosure is also generally directed to drinkware comprising: a bowl having a bottom region, and defining a receptacle area and a top opening; and a stem coupled to the bowl; wherein the bottom region and the stem define a sediment retaining feature in open communication with the receptacle area; and wherein the sediment retaining feature is conical in shape.

BRIEF DESCRIPTION OF THE DRAWINGS

The disclosure will be better understood, and features, aspects and advantages other than those set forth above will become apparent when consideration is given to the following detailed description thereof. Such detailed description makes reference to the following drawings, wherein.

Figure 1:
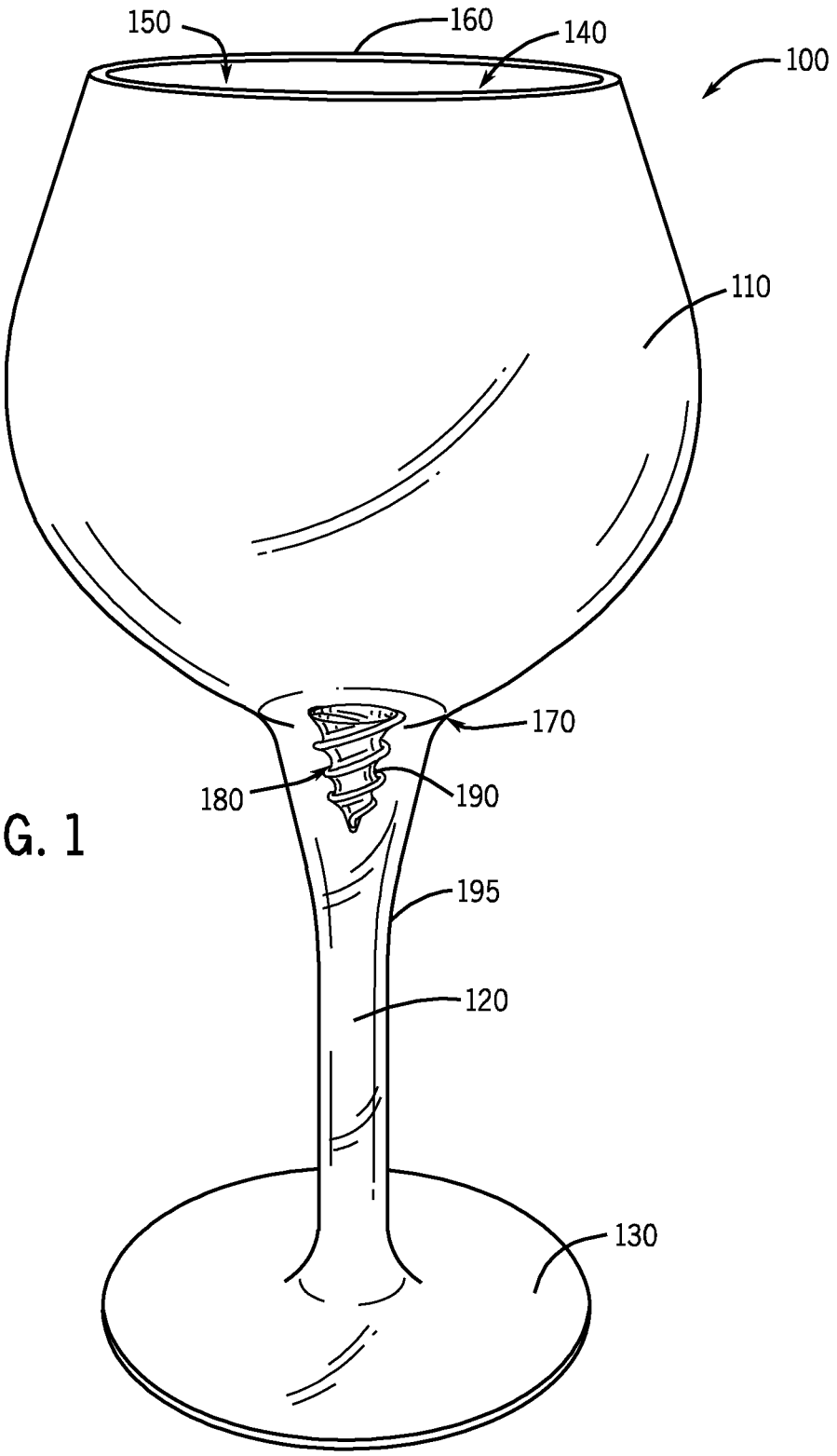
FIG. 1 illustrates an isometric view of a wine glass, according to various examples of embodiments.
Figure 2:
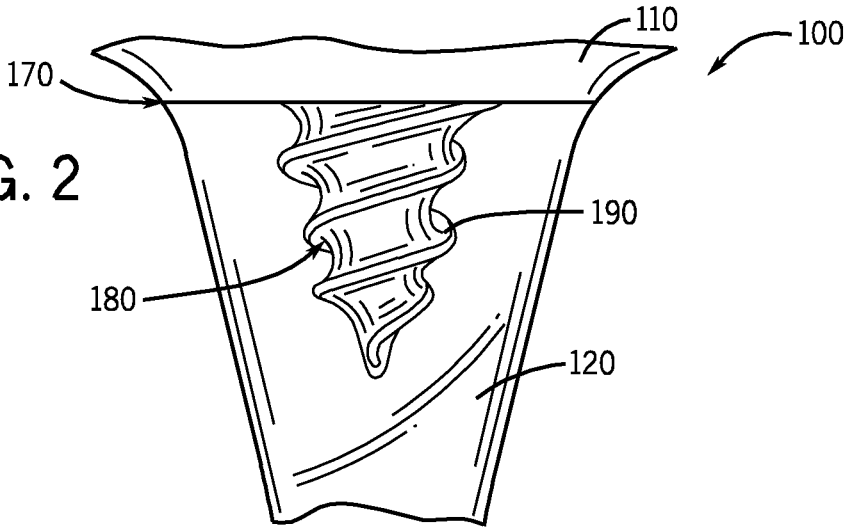
FIG. 2 illustrates a detailed view of the wine glass shown in FIG. 1, according to various examples of embodiments.
Figure 3:
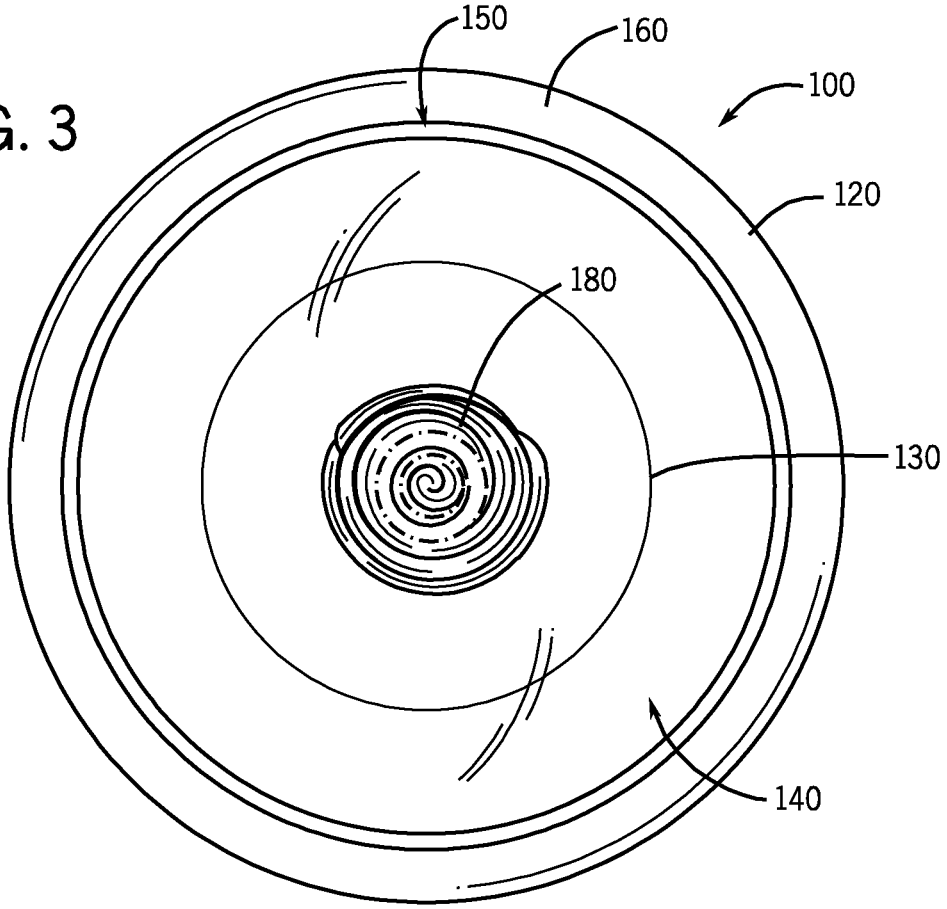
FIG. 3 illustrates a top view of a wine or other beverage glass, according to various examples of embodiments.
Figure 4:
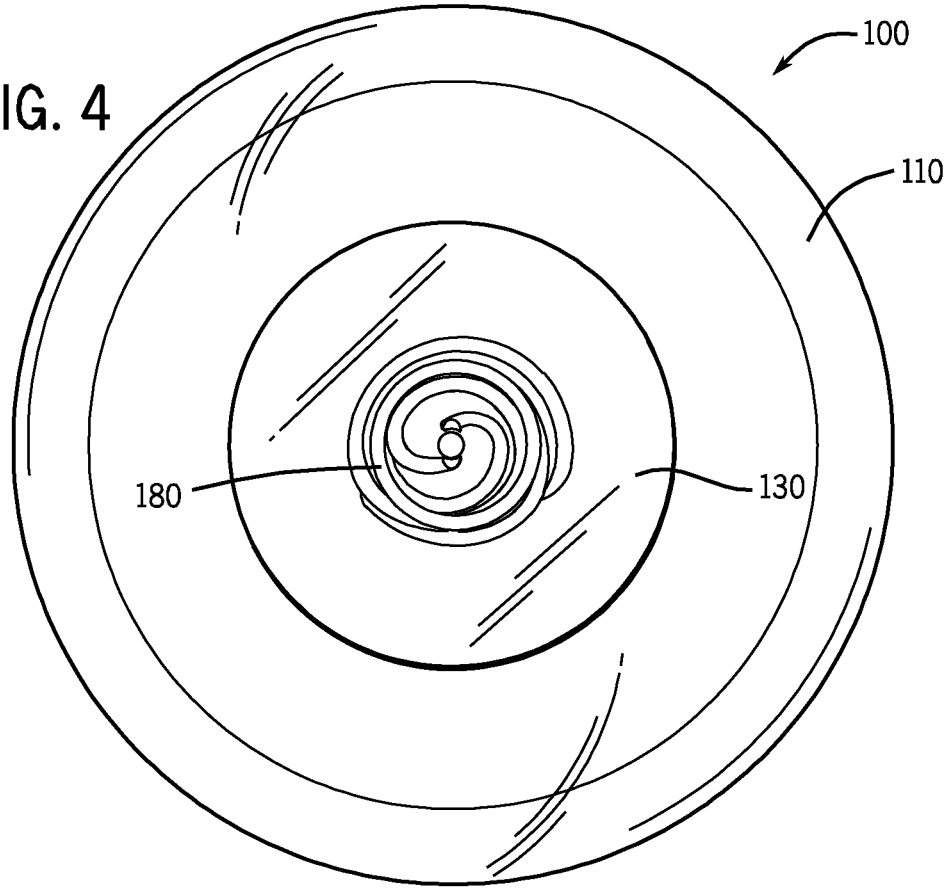
FIG. 4 illustrates a bottom view of the wine glass shown in FIG. 1, according to various examples of embodiments.

While the disclosure is susceptible to various modifications and alternative forms, specific embodiments thereof have been shown by way of example in the drawings and are herein described below in detail. For example, any numbers, measurements, and/or dimensions illustrated in the Figures are for purposes of example only. Any number, measurement or dimension suitable for the purposes provided herein may be acceptable. It should be understood that the description of specific embodiments is not intended to limit the disclosure from covering all modifications, equivalents and alternatives falling within the spirit and scope of the disclosure.

DETAILED DESCRIPTION

Unless defined otherwise, all technical and scientific terms used herein have the same meaning as commonly understood by one of ordinary skill in the art to which the disclosure belongs. Although any methods and materials similar to or equivalent to those described herein may be used in the practice or testing of the present disclosure, example methods and materials are described below.

Referring to FIGS. 1-4, drinkware 100 according to various embodiments is shown. In various embodiments, drinkware 100 includes a bowl 110, a stem 120, and a foot or base 130. Bowl 110 is adapted to hold a quantity of wine or other beverage.

The shape of bowl 110 may be altered to suit the liquid or beverage that is intended to be provided inside bowl 110. For example, white wine is traditionally served in narrower glasses with a substantially cylindrically-shaped bowl and red wine is traditionally served in wider glasses with a substantially spherically-shaped bowl. Champagne is traditionally served in drinkware such as or commonly referred to as a flute, which often has a bowl which is narrower and taller than that of a typical wine glass. The bowl of the present disclosure may have a range of sizes and/or shapes, including spherical and cylindrical and may have convex sides, concave sides, or straight sides. Such variations may be based on a number of factors including, without limitation, function design requirements (e.g., an ideal functional design requirement for any particular beverage(s)) or based solely or partially on aesthetic value (e.g., an aesthetic value that is most pleasing).

Bowl 110 includes or otherwise defines a receptacle area 140 and an opening 150 at a top end 160 (e.g., for drinking). In various embodiments, bowl 110 includes a bottom region 170 which is symmetrically disposed about a central axis. In various embodiments, stem 120 meets bowl 110 at bottom region 170 and connects or couples bowl 110 to foot or base 130. In various embodiments, bottom region 170 and/or stem 120 defines a recess, cavity, aperture, or sediment retaining feature 180.

As shown in the Figures, recess or cavity 180 may extend from bottom region 170 into stem 120 of drinkware 100. In other various embodiments (for example, in drinkware without a stem), the recess or cavity may extend only into the bottom region. In various embodiments, cavity or recess 180 is in open, operative or fluid communication with receptacle area 140.

As shown in FIGS. 1-4, in various embodiments, recess or cavity 180 has a helical, spiral, and/or corkscrew shape or configuration. In various embodiments, a wall of recess or cavity 180 is provided with at least one helical or spiral ridge 190. In various embodiments, a wall of the recess or cavity defines at least one spiral groove. As shown in FIGS. 1-4, cavity or recess 180 is a dextrorotatory spiral or helix in that it curves to the right as it moves away from top end 160. In alternative embodiments, however, the recess or cavity may be a levorotatory spiral or helix, in that it curves toward the left as it moves away from the top end.

In various embodiments, cavity or recess 180 is a spiral or helix that makes at least one complete rotation (e.g., about the central axis). However, it should be appreciated that the cavity or recess may be a spiral or helix making less than a complete rotation. The angle of rotation of the recess helix or spiral may also vary (e.g., by the type of drinkware, along the length of the recess, etc.) The recess helix or spiral may have any pitch or angle (or combinations or ranges of pitches and angles).

In various embodiments, cavity or recess 180 is symmetrically disposed about the central axis. However, in various other embodiments, at least part of the cavity or recess may not be symmetrically disposed about the central axis. For example, the recess or cavity may curve along its length relative to the central axis.

As shown in FIGS. 1-4, in various embodiments, the cavity or recess generally narrows in diameter or radius (e.g., from the central axis) or generally shrinks in cross-sectional area as it moves away from top end 160 of drinkware 100. It should be appreciated, however, that the recess may have a substantially consistent diameter, radius (e.g., from the central axis) or cross-sectional area throughout its length or may generally increase in diameter, radius or cross-sectional area as it moves away from the top opening.

In various embodiments, cavity or recess 180 is in the form of a logarithmic spiral. However, it should be appreciated that any type of spiral including an archimedean spiral, a cornu spiral, a hyperbolic spiral, etc., may be utilized.

Stem 120 has an exterior or outer surface 195. In various embodiments, exterior surface 195 of stem 120 is shaped independently from, or independent relative to, cavity or recess 180. For example, exterior surface 195 of stem 120 may be shaped like or similar to a traditional wine glass stem. In various embodiments, the exterior or outer surface of the stem may be adjusted to suit or better accommodate the cavity or recess at least partially defined by the stem. For example, the diameter or cross-section of the stem may be larger than a traditional wine glass stem at least partly along its length to accommodate the recess at least partially defined by the stem.

Figure 5:
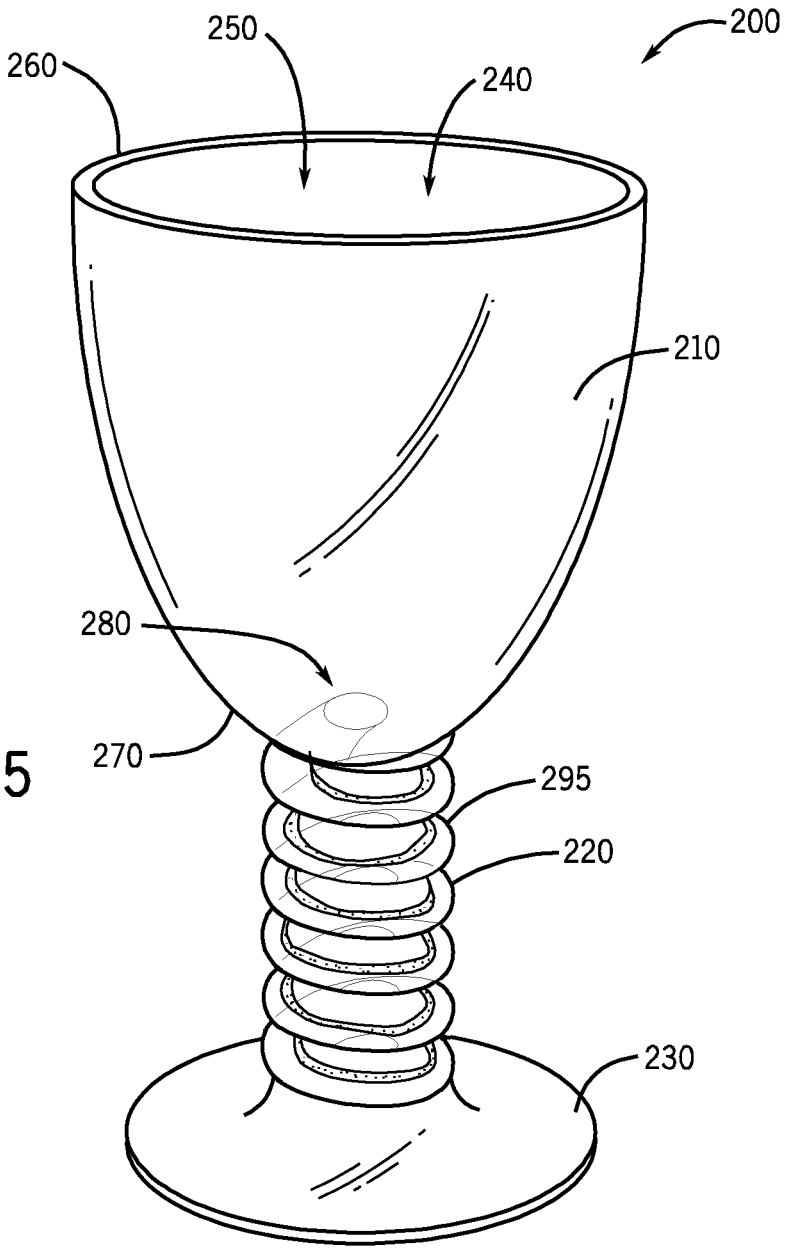
FIG. 5 illustrates an isometric view of a wine or other beverage glass, goblet or challis, according to various examples of embodiments.

Referring now to FIG. 5, drinkware 200 according to various embodiments is shown. In various embodiments, drinkware 200 includes a bowl 210, a stem 220, and a foot or base 230. Bowl 210 is adapted to hold a quantity of wine or other beverage. Bowl 210 includes or otherwise defines a receptacle area 240 and an opening 250 at a top end 260 (e.g., for drinking). In various embodiments, bowl 210 includes a bottom region 270 which is symmetrically disposed about a central axis. In various embodiments, stem 220 meets bowl 210 at bottom region 270 and connects or couples bowl 210 to foot or base 230. In various embodiments, bottom region 270 and/or stem 220 defines a recess, cavity, aperture, or sediment retaining feature 280. Stem 220 has an exterior or outer surface 295. As shown in FIG. 5, stem 220 may correspond to or be similar in configuration or shape to the recess (for example, it may be in helical, spiral or coiled form similar to the recess defined therein). Cavity or recess 280 in various embodiments extends from bottom region 270 of bowl 210 through a majority of stem 220. For example, as shown in FIG. 7, cavity or recess 280 may extend from bottom region 270 of bowl 210 almost throughout the entirety of stem 220, or at least throughout the majority of stem 220 or length of stem 220.

Figure 6:
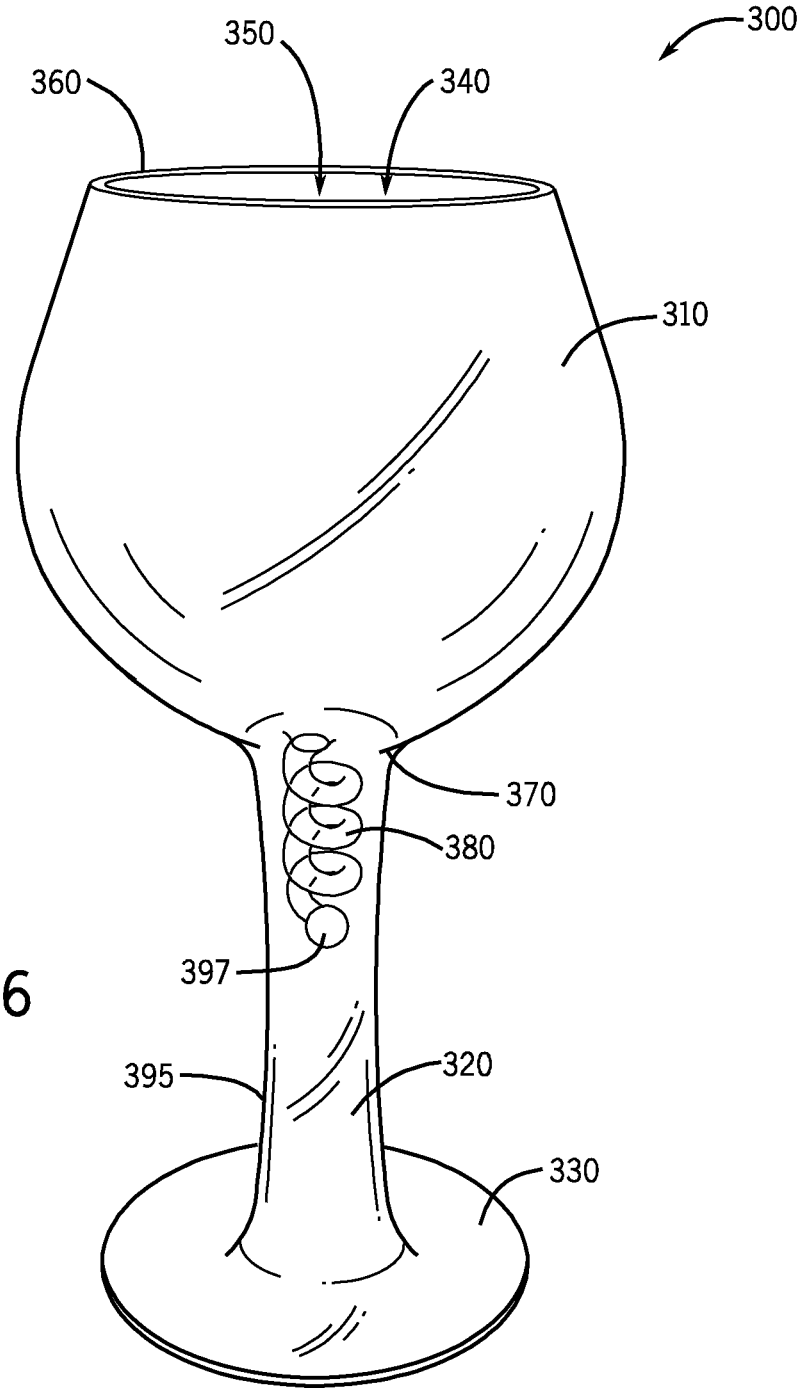
FIG. 6 illustrates a perspective view of a wine or other beverage glass, goblet or challis, according to various examples of embodiments.
Figure 7:
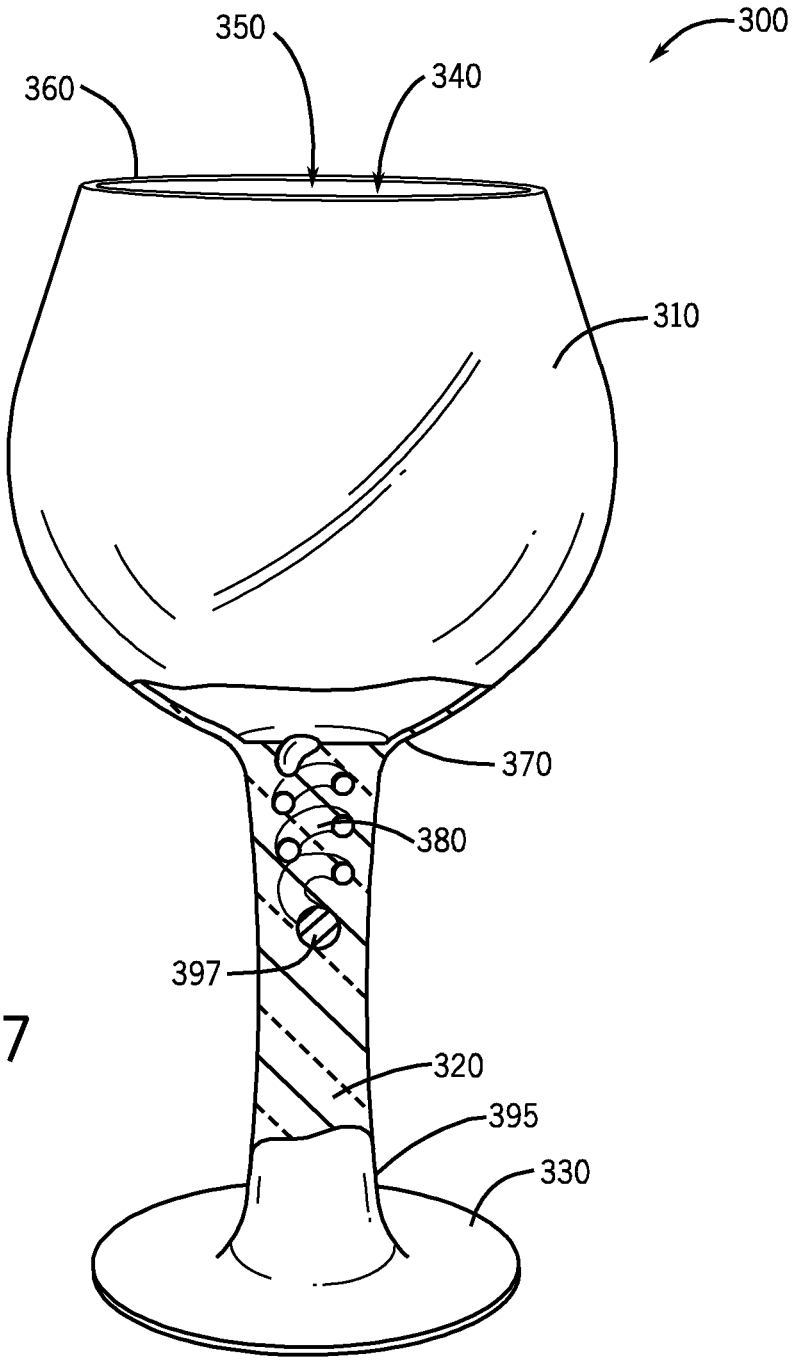
FIG. 7 illustrates a cut-away perspective view of the wine or other beverage glass, goblet or challis shown in FIG. 6, according to various examples of embodiments.

Referring now to FIGS. 6-7, an alternative embodiment of drinkware 300 is shown. In various embodiments, drinkware 300 includes a bowl 310, a stem 320, and a foot or base 330. Bowl 310 is adapted to hold a quantity of wine or other beverage. Bowl 310 includes or otherwise defines a receptacle area 340 and an opening 350 at a top end 360 (e.g., for drinking). In various embodiments, bowl 310 includes a bottom region 370 which is symmetrically disposed about a central axis. In various embodiments, stem 320 meets bowl 310 at bottom region 370 and connects or couples bowl 310 to foot or base 330. In various embodiments, bottom region 370 and/or stem 320 defines a recess, cavity, aperture, or sediment retaining feature 380. Stem 320 has an exterior or outer surface 395.

In various embodiments, cavity or recess 380 defined by lower region 370 of bowl 310 and/or top region of stem 320 may also terminate in or otherwise include a pocket or other relatively bulbous feature 397 (e.g., at the end of recess 380 furthest from the top end 360). In various embodiments, pocket 397 is hollow or otherwise helps define a hollow space (e.g., when the drinkware is empty). In various embodiments, however, a member such as a decorative object (e.g., bead or cube) may be provided in the pocket.

In various embodiments, multiple pockets may be provided in or along the length of the cavity or recess (e.g., to help confine and/or separate sediment and/or to help sediment to settle in cavity or recess). It should be appreciated that any number of pockets or more bulbous features may be provided in the cavity or recess and at various positions along the cavity or recess.

Figure 8:
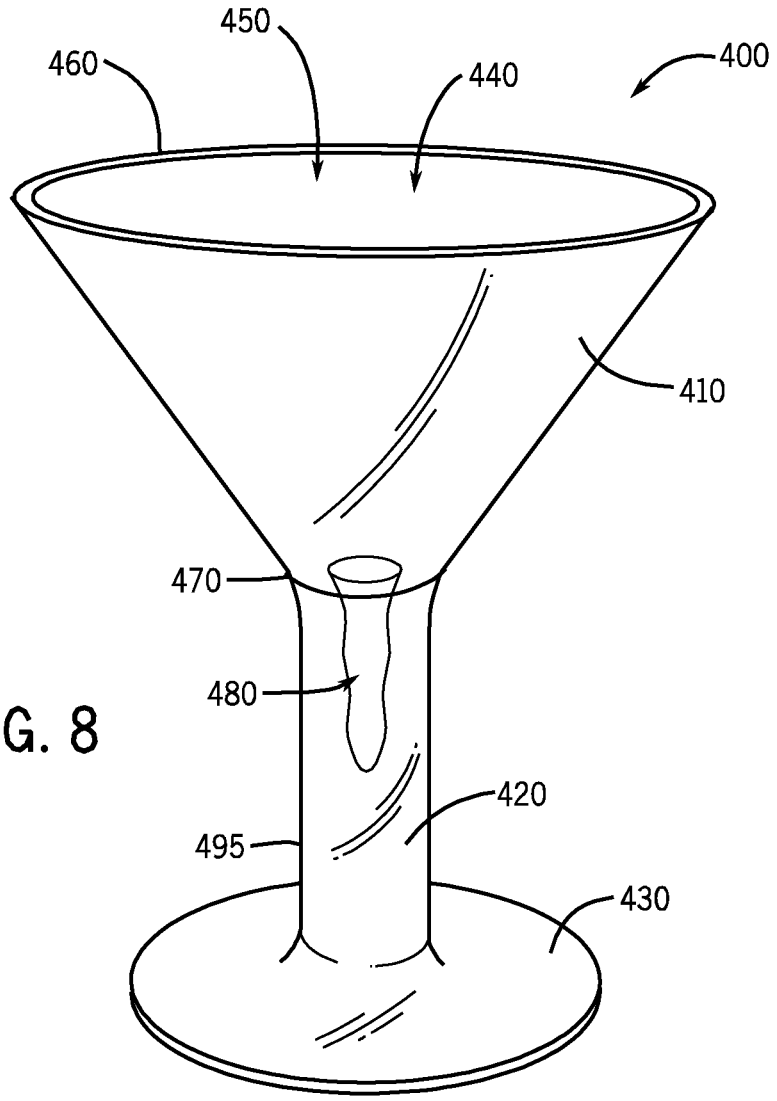
FIG. 8 illustrates a perspective view of a cocktail or other beverage glass, according to various examples of embodiments.

Referring now to FIG. 8, an alternative embodiment of drinkware 400 is shown. In various embodiments, drinkware 400 includes a bowl 410, a stem 420, and a foot or base 430. Bowl 410 is adapted to hold a quantity of wine or other beverage. Bowl 410 includes or otherwise defines a receptacle area 440 and an opening 450 at a top end 460 (e.g., for drinking). In various embodiments, bowl 410 includes a bottom region 470 which is symmetrically disposed about a central axis. In various embodiments, stem 420 meets bowl 410 at bottom region 470 and connects or couples bowl 410 to foot or base 430. In various embodiments, bottom region 470 and/or stem 420 defines a recess, cavity, aperture, or sediment retaining feature 480. Stem 420 has an exterior or outer surface 495.

In various alternative embodiments, and as shown in FIG. 8, drinkware 400 may take a variety of shapes (e.g., as a margarita or martini glass). In various embodiments, cavity or recess 480 is defined at least in part by stem 420 and may take any variety of shapes. For example, as shown in FIG. 8, cavity or recess 480 may be a conical shape or configuration with little or no spiral shape or configuration. In various embodiments, and as shown in FIG. 8, cavity or recess 480 may narrow in diameter, radius (e.g., from the central axis), may be reduced in cross-sectional area, or otherwise taper along its length as it moves away from top end 460 of drinkware 400.

Figure 9:
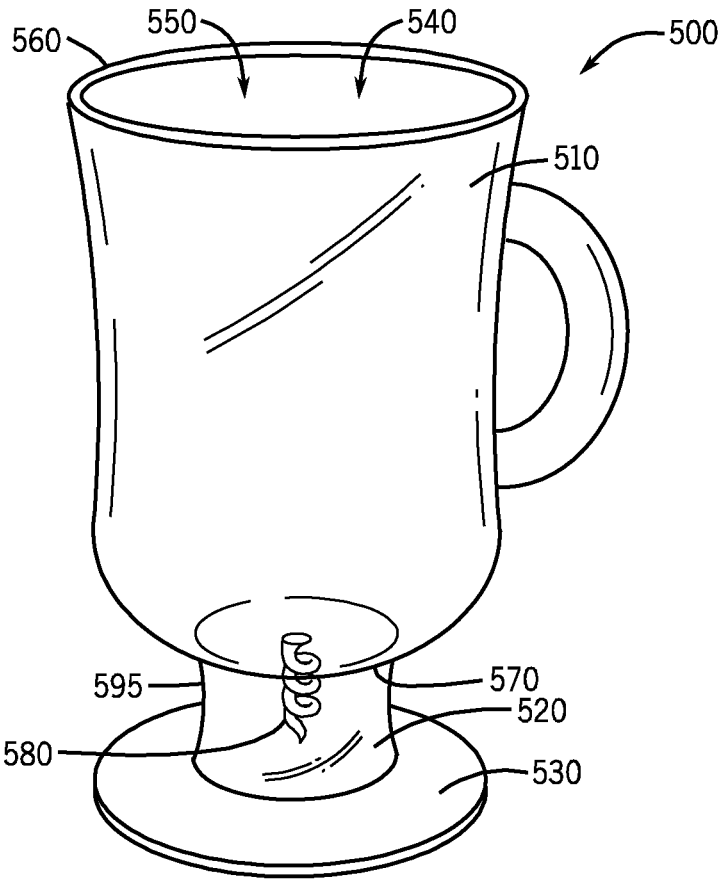
FIG. 9 illustrates a perspective view of a coffee or other beverage glass, cup or mug, according to various examples of embodiments.

Referring now to FIG. 9, an alternative embodiment of a drinkware 500 is shown. In various embodiments, drinkware 500 includes a bowl 510, a stem 520, and a foot or base 530. Bowl 510 is adapted to hold a quantity of liquid or beverage. Bowl 510 includes or otherwise defines a receptacle area 540 and an opening 550 at a top end 560 (e.g., for drinking). In various embodiments, bowl 510 includes a bottom region 570 which is symmetrically disposed about a central axis. In various embodiments, stem 520 meets bowl 510 at bottom region 570 and connects or couples bowl 510 to foot or base 530. In various embodiments, bottom region 570 and/or stem 520 defines a recess, cavity, aperture, or sediment retaining feature 580. Stem 520 has an exterior or outer surface 595. In various embodiments, stem 520 of drinkware 500 may be shorter compared to the height of bowl 510 (or length from top end 560 to bottom region 570).

Figure 10:
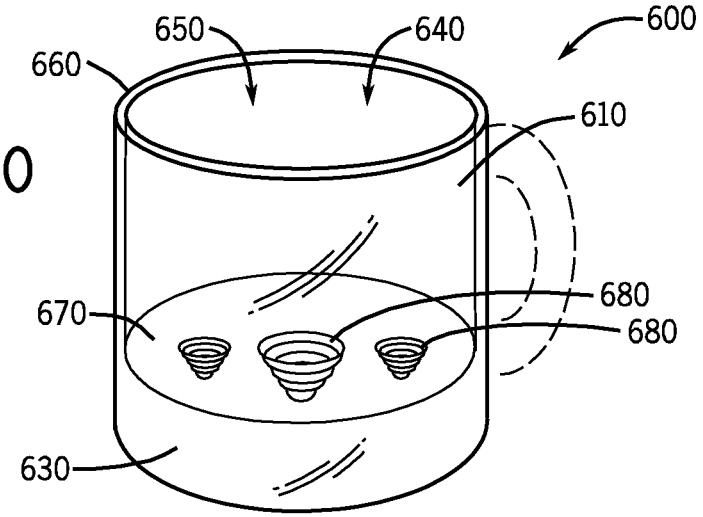
FIG. 10 illustrates a perspective view of a cocktail or other beverage glass, according to various examples of embodiments.

Referring now to FIG. 10, an alternative embodiment of a drinkware 600 is shown. In various embodiments, drinkware 600 includes a bowl 610 and a foot or base 630. Bowl 610 is adapted to hold a quantity of wine or other beverage. Bowl 610 includes or otherwise defines a receptacle area 640 and an opening 650 at a top end 660 (e.g., for drinking). In various embodiments, bowl 610 includes a bottom region 670 which is symmetrically disposed about a central axis. In various embodiments, bowl 610 is coupled to and/or formed in part by foot or base 630. In various embodiments, bottom region 670 and/or foot or base 630 defines a recess, cavity, aperture, or sediment retaining feature 680.

More specifically, and in various embodiments, drinkware 600 may have no stem. In drinkware 600 that does not include a stem, bottom or lower region 670 of bowl 610 and/or base or footing 630 helps define cavity or recess 680. Alternatively, in various embodiments, cavity or recess 680 extends only partially into bottom or lower region 670 of bowl 610.

In various embodiments, lower region 670 of bowl 610 and/or base or footing 630 defines or includes multiple cavities or recesses 680. While FIG. 10 illustrates three such recesses 680, it should be appreciated that a number of recesses may be utilized within the spirit and scope of this disclosure.

As shown in FIG. 10, in various embodiments, one or more multiple cavities or recesses 680 extend substantially parallel to each other. However, other recess arrangements may be utilized. For example, in various embodiments, one or more of the recesses may extend along various axes angled relative to each other. In various embodiments, while cavities or recesses 670 are shown in FIG. 10 as being substantially vertical (or parallel to a central axis), they may alternatively extend at an angle to the vertical plane or central axis (e.g., to offer an alternative embodiment for separating, segregating, collecting, confining, and/or capturing sediment in a beverage in the drinkware).

The drinkware or beverage container described above can be made or composed of any single material or combination of materials, but is preferably composed of glass, ceramic, plastic, metal, and/or lead crystal. The material may be substantially transparent, translucent, opaque, or combinations thereof. The bowl and the stem may be made as one integral piece or may be designed as to be coupled and/or removably coupled pieces for storage purposes. Although the present invention is largely discussed with respect to wine, coffee, and tea, any beverage or other liquid may be placed inside the bowl. Further, any type of drinkware (including, without limitation, margarita glasses, brandy glasses, etc.) may include or utilize a feature of the present disclosure.

In operation, a beverage (e.g., wine) is provided in the receptacle area and cavity or recess of the drinkware or beverage container. As the beverage sits or is otherwise held in the drinkware or beverage container, sediment present in the beverage (such as tannin in the wine) is allowed to settle into the cavity or recess. Operationally, when a user tilts the drinkware beyond vertical to take a drink of the beverage from within the drinkware, the cavity or recess helps prevent, impede or slow some sediment in the beverage from reaching the opening at the top end of the drinkware, thereby helping prevent the user from drinking some amount of sediment the user might otherwise drink from known or more traditional drinkware. In addition, the recess provides an aesthetically pleasing experience. One or more of these advantages can improve or otherwise contribute to the user's tasting experience.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g., by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements, and/or substantial equivalents.

The invention claimed is:

1. Drinkware comprising:

a bowl having a bottom wall, and defining a receptacle area and a top opening;

a stem coupled to the bottom wall; and a cavity disposed in the stem, the cavity having an open end in fluid communication with the receptacle area, a closed end, and a cavity length extending from the open end to the closed end;

wherein the cavity is helical and conical in shape along a majority of the cavity length.

2. The drinkware of claim 1, wherein a cross-sectional area of the cavity about the open end is larger than a cross-sectional area of the cavity nearer the closed end.

3. The drinkware of claim 1, wherein a wall of the cavity is provided with at least one helical ridge.

4. The drinkware of claim 1, wherein at least a portion of the cavity is spiral in shape.

5. The drinkware of claim 1, wherein a wall of the cavity is provided with at least one spiral ridge.

6. The drinkware of claim 1, wherein at least a portion of the cavity has a corkscrew shape.

7. Drinkware comprising:

a bowl having a bottom wall, and defining a receptacle area and a top opening;

a stem coupled to the bottom wall; and a cavity, disposed in the stem, in communication with the receptacle area;

wherein the cavity has an open end, a closed end, and a cavity length extending from the open end to the closed end; and wherein the cavity is shaped like a conical helix along a majority of the cavity length.

8. The drinkware of claim 7, wherein a cross-sectional area of the cavity about the open end is larger than a cross-sectional area of the cavity nearer the closed end.

9. The drinkware of claim 7, wherein a wall of the cavity is provided with at least one helical ridge.

10. The drinkware of claim 7, wherein at least a portion of the cavity is spiral in shape.

11. The drinkware of claim 7, wherein a wall of the cavity is provided with at least one spiral ridge.

12. The drinkware of claim 7, wherein at least a portion of the cavity has a corkscrew shape.

13. Drinkware comprising:

a bowl having a bottom wall, and defining a receptacle area and a top opening;

a stem coupled to the bottom wall; and a sediment retaining feature disposed in the stem, the sediment retaining feature having an open end in fluid communication with the receptacle area, a closed end in the stem, and a length extending from the open end to the closed end;

wherein the sediment retaining feature is helical and conical along a majority of the length of the sediment retaining feature.

14. The drinkware of claim 13, wherein a cross-sectional area of the sediment retaining feature about the open end is larger than a cross-sectional area of the sediment retaining feature nearer the closed end.

15. The drinkware of claim 13, wherein a wall of the sediment retaining feature is provided with at least one helical ridge.

16. The drinkware of claim 13, wherein at least a portion of the sediment retaining feature is spiral in shape.

17. The drinkware of claim 13, wherein a wall of the sediment retaining feature is provided with at least one spiral ridge.

18. The drinkware of claim 13, wherein at least a portion of the sediment retaining feature has a corkscrew shape.

* * * * *